US009404439B2

(12) United States Patent
Klein

(10) Patent No.: US 9,404,439 B2
(45) Date of Patent: Aug. 2, 2016

(54) PISTON WITH COOLING GALLERY AND COOLING GALLERY FINS

(71) Applicant: Mahle International GmbH, Stuttgart (DE)

(72) Inventor: Ralph Klein, Plymouth, MI (US)

(73) Assignee: Mahle International GmbH (DE)

( * ) Notice: Subject to any disclaimer, the term of this patent is extended or adjusted under 35 U.S.C. 154(b) by 351 days.

(21) Appl. No.: 14/051,756

(22) Filed: Oct. 11, 2013

(65) Prior Publication Data

US 2014/0102294 A1 Apr. 17, 2014

Related U.S. Application Data

(60) Provisional application No. 61/713,042, filed on Oct. 12, 2012.

(51) Int. Cl.

| | |
|---|---|
| ***F02F 3/16*** | (2006.01) |
| ***F02F 3/22*** | (2006.01) |
| *F02F 3/00* | (2006.01) |

(52) U.S. Cl.

CPC ... *F02F 3/16* (2013.01); *F02F 3/22* (2013.01); *F02F 2003/0038* (2013.01); *F02F 2003/0061* (2013.01); *Y10T 29/49256* (2015.01)

(58) Field of Classification Search

CPC ..... F02F 3/16; F02F 3/22; F02F 2003/0038; F02F 2003/0061

USPC ..... 92/159, 186

See application file for complete search history.

(56) References Cited

U.S. PATENT DOCUMENTS

| | | | | |
|---|---|---|---|---|
| 4,175,502 | A * | 11/1979 | Moebus | F02F 3/0023 92/186 |
| 4,368,697 | A | 1/1983 | Moebus | |
| 6,532,913 | B1 * | 3/2003 | Opris | F02B 75/20 123/193.6 |
| 6,659,062 | B1 | 12/2003 | Issler | |

(Continued)

FOREIGN PATENT DOCUMENTS

| | | | |
|---|---|---|---|
| DE | 19926568 | A1 | 12/2000 |
| DE | 102004058968 | A1 | 6/2006 |

(Continued)

OTHER PUBLICATIONS

International Search Report for PCT/US2013/064454 mailed Dec. 20, 2013.

Bibliographic Data Sheet indicating "No Abstract Available" for JPS6139452U.

Bibliographic Data Sheet indicating "No Abstract Available" for JPH0365840U.

*Primary Examiner* — Thomas E Lazo

(74) *Attorney, Agent, or Firm* — Fishman Stewart PLLC

(57) ABSTRACT

A piston may include a piston crown including radially inner and outer crown mating surfaces, the crown defining at least in part a cooling gallery extending about a periphery of the crown. The piston may include a piston skirt including a pair of oppositely disposed pin bosses, the pin bosses each defining a piston pin bore. The piston skirt may have a radially inner skirt mating surface cooperating along a radially inner interface region with the radially inner crown mating surface, and a radially outer skirt mating surface cooperating along a radially outer interface region with the radially outer crown mating surface such that the cooling gallery is substantially enclosed. The piston may include at least one cooling fin extending from an interior surface of the cooling gallery.

20 Claims, 5 Drawing Sheets

(56) References Cited

U.S. PATENT DOCUMENTS

| | | | | |
|---|---|---|---|---|
| 7,143,685 | B2 * | 12/2006 | Zhu | F02F 3/22 92/159 |
| 7,946,216 | B2 | 5/2011 | Scharp et al. | |
| 8,739,755 | B2 * | 6/2014 | Stan | F02F 3/003 123/193.6 |
| 2008/0314240 | A1 * | 12/2008 | Walker | B23P 15/10 92/186 |
| 2012/0037114 | A1 | 2/2012 | Keller et al. | |
| 2012/0145112 | A1 * | 6/2012 | Scharp | B23P 15/10 123/193.6 |
| 2013/0098316 | A1 | 4/2013 | Stan et al. | |

FOREIGN PATENT DOCUMENTS

| | | | |
|---|---|---|---|
| JP | S6139452 | U | 3/1986 |
| JP | H0365840 | U | 6/1991 |
| WO | WO-2013062955 | A1 | 5/2013 |
| WO | WO-2013075701 | A1 | 5/2013 |

* cited by examiner

PISTON WITH COOLING GALLERY AND COOLING GALLERY FINS

CROSS REFERENCE TO RELATED APPLICATIONS

This application claims priority to U.S. provisional patent application 61/713,042, filed on Oct. 12, 2012, the contents of which are hereby incorporated by reference in their entirety.

BACKGROUND

A power cylinder assembly of an internal combustion engine generally comprises a reciprocating piston disposed within a cylindrical cavity of an engine block. One end of the cylindrical cavity may be closed while another end of the cylindrical cavity may be open. The closed end of the cylindrical cavity and an upper portion or crown of the piston defines a combustion chamber. The open end of the cylindrical cavity permits oscillatory movement of a connecting rod, which joins a lower portion of the piston to a crankshaft, which is partially submersed in an oil sump. The crankshaft converts linear motion of the piston (resulting from combustion of fuel in the combustion chamber) into rotational motion.

Engines, and in particular the pistons, are under increased stress as a result of constant efforts to increase overall efficiency, e.g., by reducing piston weight and/or increasing pressures and temperatures associated with engine operation. Piston cooling is therefore increasingly important for withstanding the increased stress of such operational conditions over the life of the engine. To reduce the operating temperatures of piston components, a cooling gallery may be provided about a perimeter of the piston, into which crankcase oil may be introduced to reduce the operating temperature of the piston.

Known piston designs having peripheral cooling galleries may not provide adequate cooling. Additional cooling features may be difficult to form or otherwise assemble with existing cooling gallery and piston designs. Accordingly, there is a need for a robust, lightweight piston design that provides enhanced cooling, such as by providing a cooling gallery, while also allowing reliable and cost-efficient production of the piston in a mass manufacturing environment.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows.

DETAILED DESCRIPTION

Figure 1:
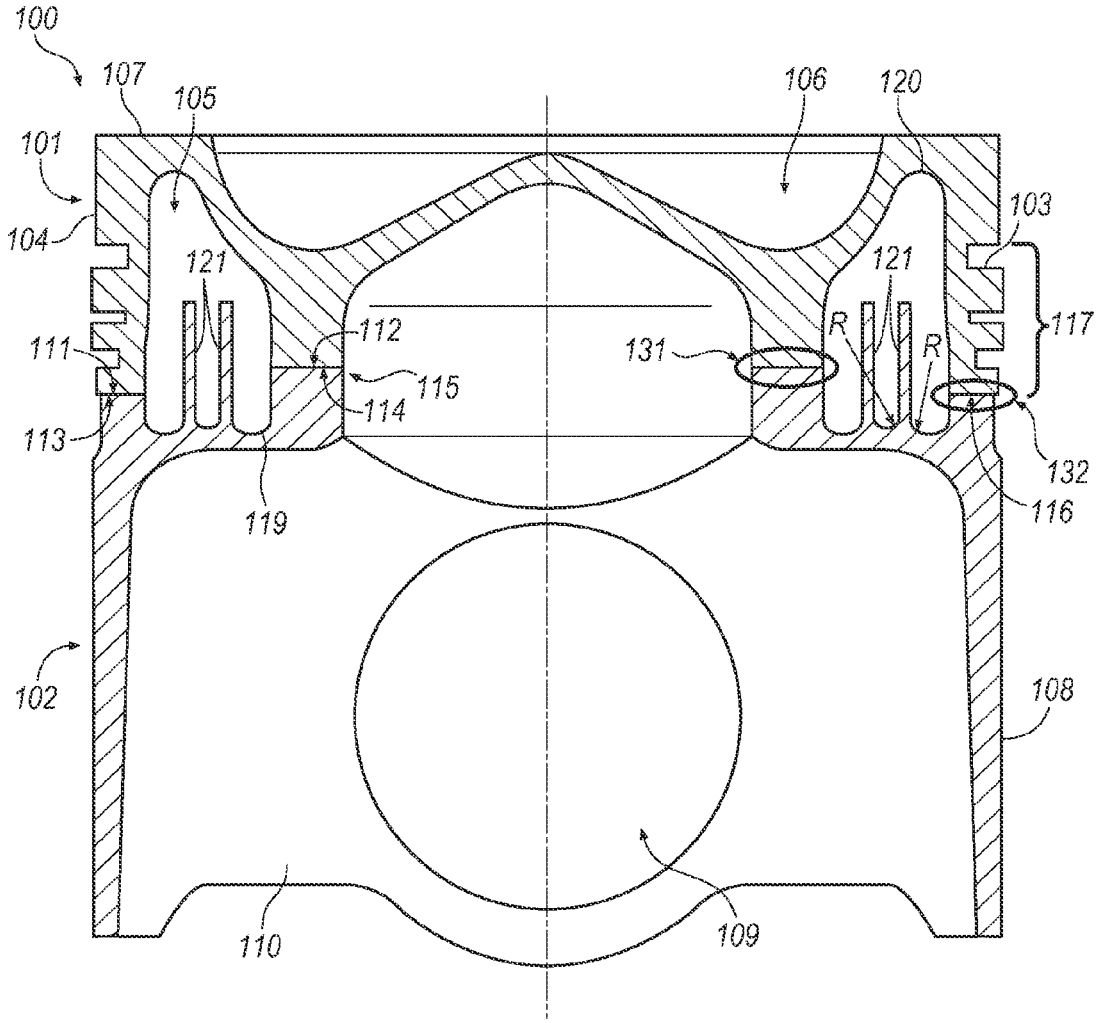
FIG. 1 illustrates an exemplary piston having an annular cooling gallery, where the piston includes a joint between the upper and lower parts that is positioned below the combustion bowl, and cooling fins that extend upward from a lower surface of the cooling gallery.

FIGS. 1-3, 4A, and 4B illustrate exemplary piston assemblies. A piston assembly 100 may include a piston crown 101 and a piston skirt 102 that may be joined together, e.g., by a welding process, such as friction welding or laser welding, or by a brazing process, merely as examples. As shown, piston ring grooves 103 may be provided about the perimeter or periphery 104 of the crown 101 adjacent an annular cooling gallery 105. Additionally, a combustion bowl 106 may also be formed in an upper surface 107 of the crown 101.

With reference to FIG. 1, the piston skirt 102 generally supports the crown 101 during engine operation, e.g., by interfacing with surfaces of an engine bore (not shown) to stabilize the piston assembly 100 during reciprocal motion within the bore. For example, the skirt 102 may have an outer surface 108 that generally defines a circular outer shape about at least a portion of a perimeter of the piston assembly 100. The outer shape may correspond to the engine bore surfaces, which may be generally cylindrical. The skirt 102 may generally slide along the bore surfaces as the piston moves reciprocally within the bore (not shown).

The skirt 102 may also include piston pin bosses 110 extending downward from the skirt 102. The piston pin bosses 110 may generally be formed with apertures 109 configured to receive a piston pin (not shown). For example, a piston pin may be inserted through the apertures 109 in the piston pin bosses 110, thereby generally securing the skirt 102 to a connecting rod (not shown). The pin bosses 110 may generally define an open area between the pin bosses 110, e.g., for receiving the connecting rod (not shown).

An exemplary piston assembly 100 may include a crown 101 defining radially outer and inner mating surfaces 111, 112 that are abutted with corresponding radially outer and inner mating surfaces 113, 114 of the skirt 102. The mating surfaces may each extend about at least a portion of a circumference of the crown 101 and skirt 102, respectively. The radially outer and inner crown mating surfaces 111, 112, respectively, may generally extend substantially about an entire periphery of the crown 101. Similarly, the radially outer and inner skirt mating surfaces 113, 114 also extend about substantially the entire periphery of the piston assembly 100 and/or skirt 102, and generally correspond to the crown mating surfaces 111, 112.

The crown 101 and skirt 102 mating surfaces may cooperate to define a radially inner interface region 115 between the radially inner mating surfaces 112, 114 and a radially outer interface region 116 between the radially outer mating surfaces 111, 113. Where the crown 101 and skirt 102 are fixedly secured, the crown and skirt 102 may be secured to each other via one or both of the interface regions 115, 116.

A circumferentially extending cooling gallery 105 may be defined in part by the ring belt portion 117 of the crown 101 and the skirt 102. For example, the crown 101 and skirt 102 cooperate to define a cooling gallery 105 that generally extends about a perimeter of the piston crown 101, and may circulate a coolant during operation, e.g., engine oil, thereby reducing an operating temperature of the piston. Additionally, the circulation of the coolant may facilitate the maintaining of a more stable or uniform temperature about the piston assembly 100, and especially in the upper portion of the piston assembly 100, e.g., the crown 101 and combustion bowl 106.

The crown 101 and skirt 102 may generally cooperate to define the cooling gallery 105 between the radially inner interface region 115 and the radially outer interface region 116. More specifically, the skirt 102 may form a lower boundary 119 of the cooling gallery 105, thereby enclosing the cooling gallery 105 within the crown 101, which may form at least part of an upper boundary 120 of the cooling gallery 105, and preventing coolant from freely entering and escaping the cooling gallery 105. At the same time, one or more apertures (not shown) may also be provided to allow oil or other coolants to exit and enter the cooling gallery 105 to/from the engine (not shown) in a controlled manner, thereby further reducing and/or stabilizing operating temperatures associated with the piston and components thereof.

The crown mating surfaces 111, 112 may, prior to joining to the skirt mating surfaces 113, 114, generally define flat or planar circumferentially extending surfaces that align with the corresponding radially inner and outer mating surfaces 115, 116 of the piston skirt 102. The skirt mating surfaces 113, 114 and crown mating surfaces 111, 112 may each be aligned generally parallel to the corresponding mating surface on the other component, thereby facilitating abutment of the crown mating surfaces 111, 112 with the skirt mating surfaces 113, 114, respectively.

The piston crown 101 and the piston skirt 102 illustrated in FIG. 1 may be secured or fixedly joined to one another in any manner that is convenient including, but not limited to, welding methodologies such as friction welding, beam welding, laser welding, or non-welding methodologies such as soldering, brazing, or adhesive bonding, merely as examples. In one example, the piston crown 101 and skirt 102 are joined in a welding process, e.g., friction welding or laser welding. In another exemplary illustration, one or both crown mating surfaces 111, 112 may be secured to their respective skirt mating surface 113, 114 in any manner that is convenient, e.g., by way of a welding operation such as friction welding or adhesive bonding, merely as examples, thereby securing the crown 101 and skirt 102 together.

The radially outer mating surfaces of the crown and skirt illustrated in FIG. 1, respectively, may be in abutment due to the securement of the radially inner mating surfaces 112, 114, and need not be fixedly secured. Alternatively, the radially outer mating surfaces 111, 113 may be fixedly secured, e.g., by a friction welding process. Welding, bonding, or any other manner that is convenient may be employed to join the mating surfaces. Fixed securement of both pairs of the radially outer and inner mating surfaces, e.g., by welding, may be desirable, for example, for particularly heavy-duty piston applications where maximum durability is desired.

By fixedly joining the piston crown 101 and the piston skirt 102, the piston assembly 100 is generally formed as a one-piece or "monobloc" assembly where the crown 101 and skirt 102 components are joined at interface regions that include the radially inner mating surfaces 112, 114 and radially outer mating surfaces 111, 113 respectively. That is, the piston crown 101 is generally unitized with the piston skirt 102, such that the piston skirt 102 is immovable relative to the piston crown 101 after securement to the crown, although the crown 101 and skirt 102 are separate components.

The piston crown 101 and piston skirt 102 may be constructed from any materials that are convenient. In one exemplary illustration, the crown 101 and skirt 102 are formed of the same material, e.g., steel. In another example, the piston crown 101 may be formed of a different material than the piston skirt 102.

In examples where the crown 101 and skirt 102 are welded together, e.g., by friction welding, one or more weld flashings (not shown) may be formed between the crown 101 and skirt 102. More specifically, weld flashings may be formed that extend radially outwardly and inwardly, respectively, from the radially inner interface region 115. Additionally, a weld flashing may be formed that extends radially inwardly from the radially outer interface region 116. Another weld flashing may extend radially outwardly from the radially outer interface region 116 and may generally be a further byproduct of a friction welding operation along the radially outer interface region 116. The weld flashing extending radially outwardly from the radially outer interface region 116 may be subsequently removed, e.g., by machining, to form the relatively smooth outer surface of the piston assembly 100 and/or piston ring grooves 103 therein.

As shown in FIG. 1, one or more cooling fins 121 may be provided in the cooling gallery 105. The cooling fins 121 may be formed integrally with the cooling gallery 105, e.g., by forging or casting the fin 121 integrally with the crown 101 or skirt 102 parts. Integrally forming the cooling fins 121 with the crown 101 or skirt 102 may enhance the cooling fins' 121 structural stability as no coupling mechanism is required to attach cooling fin 121 to the cooling gallery surface. Likewise, integrally forming the cooling fin 121 with the cooling gallery block, e.g., by machining, may reduce production or manufacturing time as the cooling fin 121 may be formed in conjunction with forming the crown 101 or skirt 102. In an alternative exemplary approach, the cooling fins 121 may be formed as a separate component which connects to the cooling gallery surface, e.g., by welding or by brazing/soldering. The cooling fins 121 may extend substantially about the entire circumference or perimeter of the piston. The fins 121 may thereby provide increased surface area in the interior of the gallery 105, thereby enhancing a cooling effect of coolant (e.g., engine oil) circulated within the gallery 105.

The cooling gallery fins 121 may be formed in any manner that is convenient. In one example, a relatively wide fin or block 121 is provided in the upper or lower piston part, e.g., by a forging, casting, or machining process. A plurality of fins 121 may be subsequently formed in the fin/block 121, e.g., by machining, thereby forming a plurality of relatively thin fins 121 that generally increase surface area of the gallery while minimizing any weight added by the fins 121. Thus, the cooling fins 121 may be configured in order to optimize the cooling performance and to adjust the cooling performance to meet the requirements of each individual case. The presence of the fins 121 may provide particular cooling advantages for upper regions of the piston closest to the combustion chamber, e.g., the bowl rim and top ring groove areas.

Figure 2:
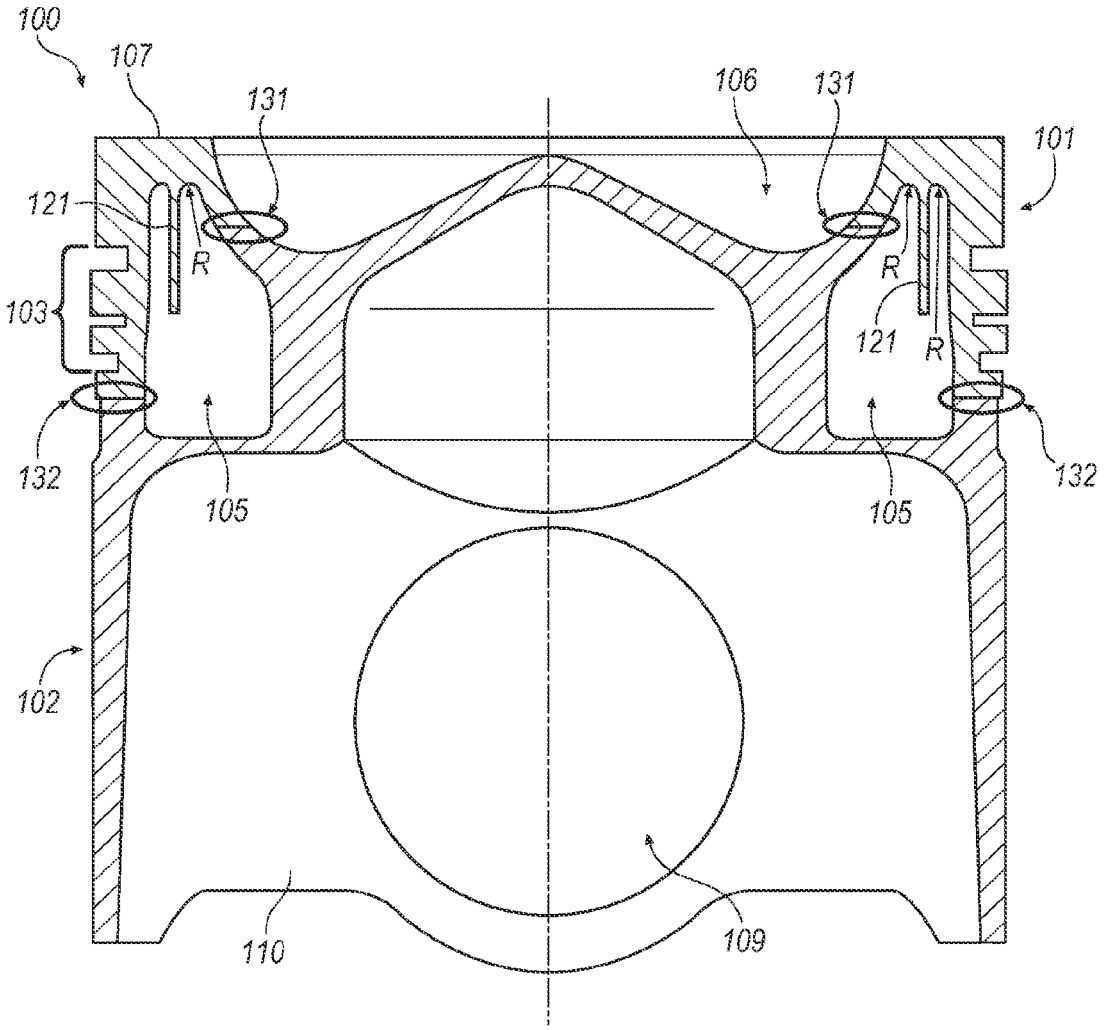
FIG. 2 illustrates an exemplary piston having an annular cooling gallery, where the piston includes a joint between the upper and lower parts that is positioned within the combustion bowl, and cooling fins that extend downward from an upper surface of the cooling gallery.
Figure 3:
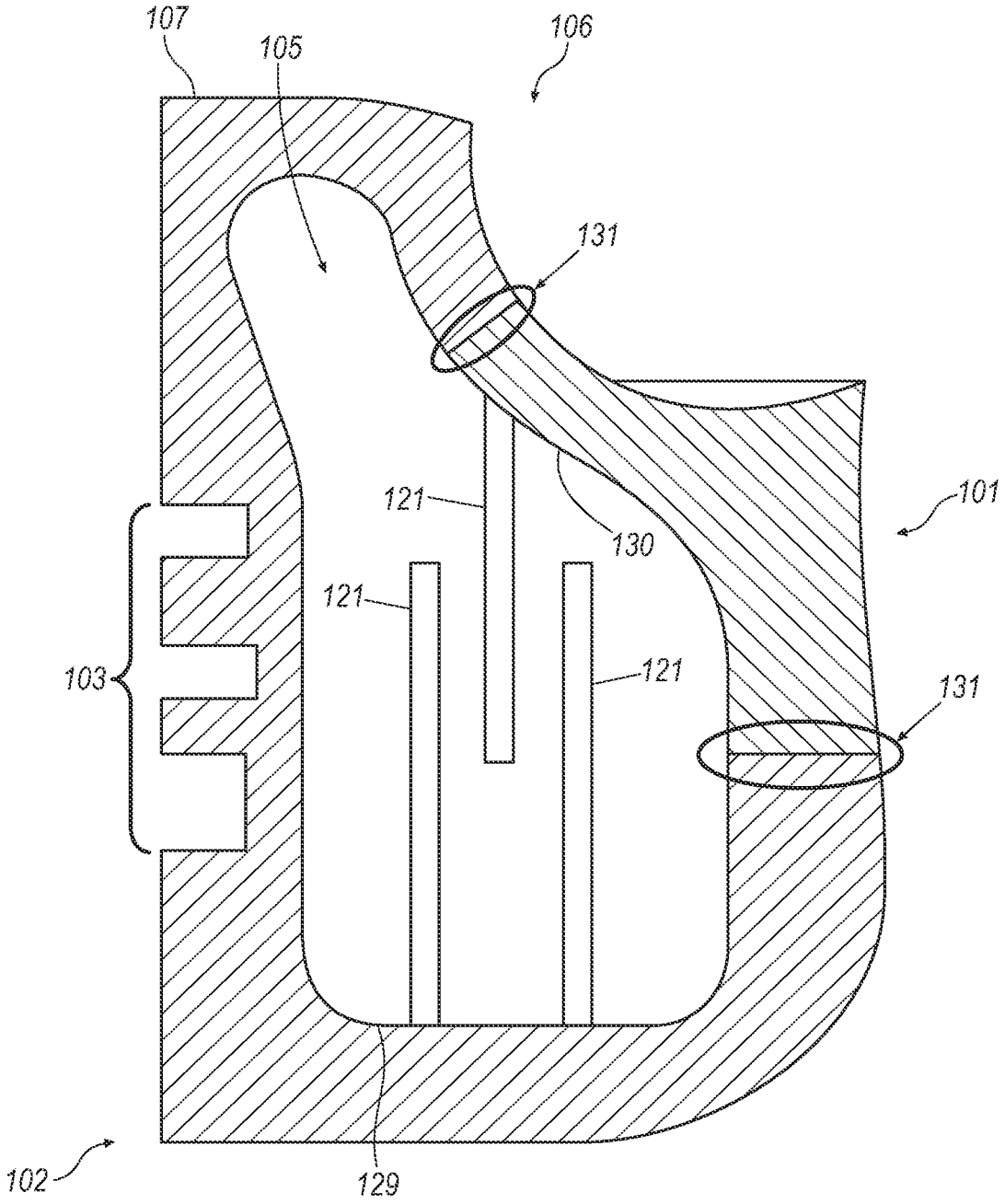
FIG. 3 shows an enlarged view of an exemplary cooling gallery of a piston, where a plurality of cooling fins are provided, with at least one cooling fin that extends downward from an upper surface of the cooling gallery, and at least one cooling fin that extends upward from a lower surface of the cooling gallery.

While the cooling gallery fins 121 illustrated in FIGS. 1, 2, and 3 may generally appear extending away from their respective cooling gallery surfaces in a vertically or substantially vertically manner, exemplary forming processes such as forging or casting may result in slightly angled surface(s) of the cooling gallery fins. As shown in FIG. 4B, for example, a radially outer surface 123 of a radially outermost cooling gallery fin 124 may be angled slightly radially inwardly, due to tolerances for a forging or casting process. Additionally, a radially inner surface 125 of a radially innermost cooling gallery fin 126 may similarly be angled slightly radially outwardly. Thus, the cooling fins 121 may include sloping sides that extend from a base (e.g., the interior surface of the cooling gallery 105) and converge at an apex, the apex of which may be generally centered with respect to the cooling fin 121.

Figure 4A:
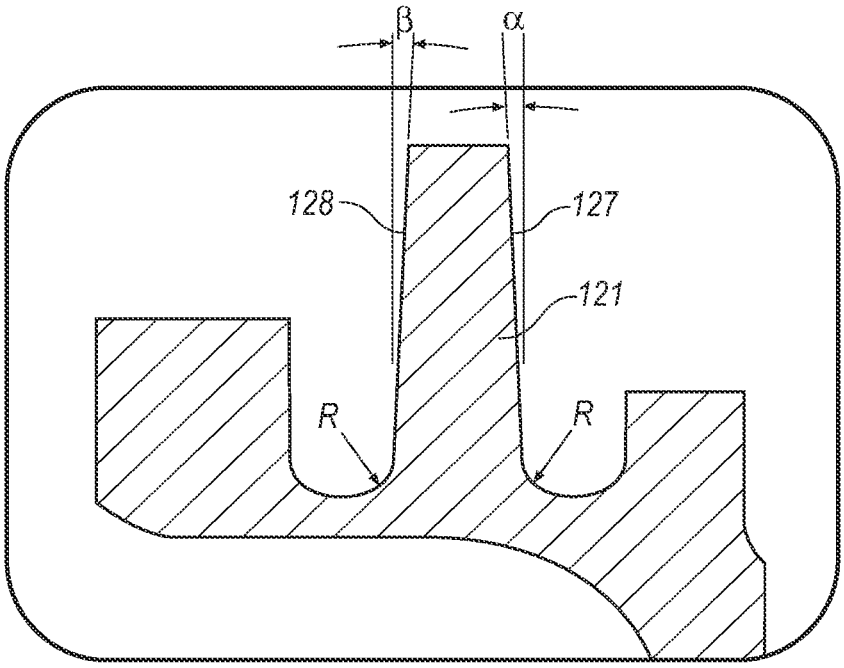
FIG. 4A shows an enlarged view of an exemplary cooling gallery block that includes angled radially outer and inner surfaces, e.g., as may result from an exemplary forging or casting process.
Figure 4B:
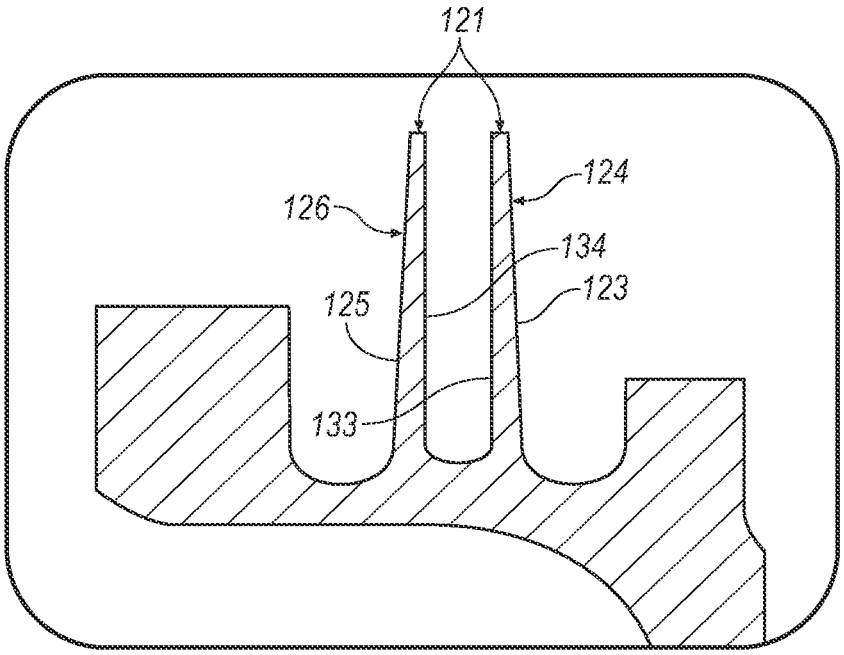
FIG. 4B shows an enlarged view of exemplary cooling gallery fins formed from the cooling gallery block shown in FIG. 4A, and including a radially outermost cooling gallery fin having an angled radially outer surface, and a radially innermost cooling gallery fin having an angled radially inner surface.

As shown in FIG. 4A, for example, an initial cast or forged cooling fin block 121 may have a radially outermost surface 127 that is angled radially inwardly in a direction moving away from the associated cooling gallery surface, thereby defining an angle $\alpha$ with vertical. A radially innermost surface 128 of the fin block 121 may similarly have an innermost surface that is angled radially outwardly in a direction moving away from the associated cooling gallery surface, thereby defining an angle $\beta$ with vertical. As noted above, these angled surfaces may result from tolerances that may be necessary to allow removal of a cast or forged part from an associated die. The angled surfaces of the cooling fins 121 may promote flow of coolant away from the apex of the cooling fin 121. Additionally, the angled surfaces of the cooling fins 121 may enhance cooling fin 121 structural stability and improve overall weight. That is, for example, a base with greater surface area (e.g., wider or thicker relative to the apex) may act as a stronger support thereby reducing undesired separation of the cooling fin 121 from the interior surface of the cooling gallery 105. Likewise, a cooling fin 121 base with a greater surface area may promote heat transfer from the cooling fluid to the cooling gallery surface. Additionally, employing a cooling fin 121 which gradually decreases in width as the height increases with respect to the interior cooling gallery surface may minimize cooling fin 121 weight due to requiring less material as the angled surfaces converge towards the apex.

As shown in FIG. 4B, after the cooling fin block 121 is initially cast or forged, a machining operation may be employed to remove material from a portion of the cooling fin block 121 to form multiple cooling gallery fins 121. More specifically, in the example shown in FIG. 4B, two fins 121 are formed. The radially outermost fin 124 may have a radially inner surface 133 that is substantially vertical, while the radially innermost fin 126 may have a radially outer surface 134 that is also substantially vertical. The substantially vertical surfaces may result from the exemplary machining process, which in contrast may more easily form a vertically extending surface relative to the piston assembly 100, as compared with forged or cast outer surfaces of the cooling gallery fins 121.

As best seen in FIG. 4A, a base of each cooling gallery fin 121 on both the radially inward and radially outward sides thereof, may define a radius R with respect to an associated cooling gallery surface. The radius R may generally result from tolerances from a forming operation associated with the cooling gallery fin block, e.g., a forging or casting operation as described above. Alternatively or additionally, with reference to FIG. 4A, a radius R extending between a cooling gallery fin 121 and an adjacent cooling gallery surface may be necessitated by tolerances or limitations of a machining operation associated with forming the cooling gallery fins 121 in the cooling gallery fin block. The radius R may provide additional surface area thereby enhancing the exchange of heat from the cooling gallery surface and cooling fluid.

The cooling gallery fins 121 may be positioned anywhere within the cooling gallery 105 that is convenient. The piston 100 shown in FIG. 1 includes a joint between the upper piston part (i.e., crown 101) and lower piston part (i.e., skirt 102). A joint may be formed by interfacing the crown 101 and skirt 102 mating surfaces. For example, a radial inner joint 131 may be formed from fixing the radially inner crown and skirt mating surfaces 112, 114. Additionally, a radially outer joint 132 may be formed by fixing the radially outer crown and skirt mating surfaces 111, 113. The joint may be included beneath the combustion bowl, as shown in FIG. 1. In such examples, it may be more difficult to form cooling fins 121 in the upper surface of the cooling gallery 105 where access is restricted by the width of the upper portion of the cooling gallery 105. It may be comparatively easier to provide fins 121 in a lower or bottom surface of the gallery 105 as a result.

Turning now to FIG. 2, another exemplary piston assembly 100 having cooling fins 121 is shown. The radially inner joint 131 of the piston is provided in the combustion bowl 106. The joint between the upper and lower piston parts, i.e., the crown 101 and skirt 102, respectively, may be welded, e.g., in a friction welding or laser welding process. The example shown in FIG. 2 includes cooling fins 121 provided in an upper surface 129 of the cooling gallery 105. In examples where a radially inner joint 131 between the upper and lower piston parts is located in the combustion bowl 106, as in FIG. 2, providing cooling fins 121 in an upper portion of the cooling gallery 105 may be more convenient since the upper part may be relatively easier to form. By comparison, access to lower portions of the cooling gallery 105 may be more restricted.

While the above examples in FIGS. 1 and 2 illustrate fins extending from only one of the upper and lower gallery surfaces 119, 120, cooling fins may be provided that extend from any interior surface of the cooling gallery 105. For example, as shown in FIG. 3, an exemplary cooling gallery 105 is illustrated having cooling fins 121 extending from both lower and upper surfaces 129, 130 of the cooling gallery 105. For example, the upper cooling gallery fin 121 may bifurcate two lower cooling gallery fins 121 extending upwards, or vice versa. As such, the surface area of the interior cooling gallery 105 is increased as a result of including more cooling fins 121, thereby improving the degree of heat transfer between the cooling surface and cooling fluid. Moreover, a radially inner joint 131 between the upper piston part and lower piston part may be provided either in or below the combustion bowl 106.

Still referring to FIG. 3, an exemplary piston may include cooling fins 121 made of a different material than the piston crown or skirt 101, 102. For example, the cooling fins 121 may be made of aluminum, stainless steel, or a similar material. Additionally or alternatively, the cooling fins 121 may be insertable and/or removable from the cooling gallery interior surface. For instance, cooling fins 121 may be added or removed in order to effectuate a desired degree of heat transfer from the cooling fluid and the interior surface of the cooling gallery 105. Further, the cooling fins 121 may vary in height relative to the cooling gallery surface and the cooling fins may vary in width. Consequently, the cooling fin 121 may be lighter overall as compared to integrally formed cooling fins 121 and may likewise be insertable and/or removable if damaged or to increase/decrease the surface area of the interior surface of the cooling gallery 105.

Accordingly, cooling gallery fins 121 may be provided that extend from interior surface(s) 119, 120 of a piston cooling gallery 105 that increase overall cooling effect of a coolant circulated within the cooling gallery 105 by increasing surface area of the cooling gallery 105. The increase in cooling effect may allow correspondingly increased tolerance of high temperatures and pressures, allowing greater power requirements to be met with the piston.

Figure 5:
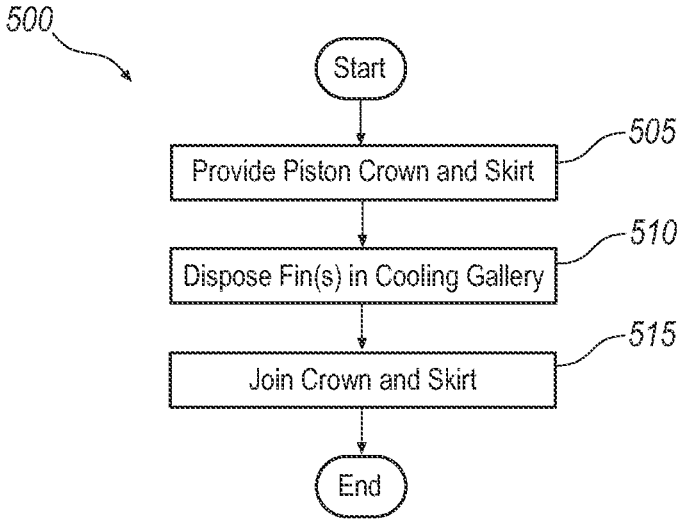
FIG. 5 is a flow chart illustrating a method of assembling the piston of FIG. 1.

FIG. 5 illustrates a method 500 of configuring the piston assembly 100. At block 505, the upper part or piston crown 101 having radially inner and outer crown mating surfaces 111, 112 may be provided. The crown 101 may define at least in part the upper portion of the cooling gallery 105 extending in the periphery of the crown 101. The piston assembly 100 may include a corresponding lower part or piston skirt 102 having radially inner and outer skirt mating surfaces 113, 114. The skirt 102 may define at least in part the lower portion of the cooling gallery 105 extending in the periphery of the skirt 102. The skirt 102 may include a pair of oppositely disposed pin bosses 110 defining piston pin bores 109.

At block 510, the method 500 may proceed by disposing at least one cooling gallery fin 121 extending from an interior surface of the cooling gallery 105. For example, the cooling gallery fins 121 may be integrally formed in the crown 101 or skirt 102 by forging, casting, or machine processing. Alternatively, the cooling fin(s) 121 may be insertable and securely fixed onto the cooling gallery interior surface. The cooling gallery 105 may include a single fin 121, or a plurality of fins 121. The cooling gallery fin(s) 121 may extend from the lower boundary or surface of the cooling gallery 105 (e.g., extending substantially vertically from the skirt 102) or from the upper boundary of the cooling gallery 105 (e.g., extending substantially vertical from the piston crown 101). Additionally or alternatively, multiple cooling fins 121 may extend from the upper or lower cooling gallery surface.

At block 515, the method 500 may include abutting the inner and outer crown mating surfaces 111, 112 with the corresponding inner and outer skirt mating surfaces 113, 114 to form a radially inner interface region 115 between the inner mating surfaces 112, 114, and a radially outer interface region 116 between the outer mating surfaces 111, 113. The cooling gallery 105 may be disposed between the radially inner and outer interface regions 115, 116. Interfacing the inner crown and skirt mating surfaces 111, 113 along the radially inner interface region 115 may form a radially inner joint 131, which may be positioned located in or below the combustion bowl area 106. The radially inner and outer crown mating surfaces 111, 112 may be fixed to the radially inner and outer skirt mating surfaces 113, 114 by friction welding, laser welding, brazing, or soldering. In one example, the radially outer crown and skirt mating surfaces 111, 113 may be in abutment due to the securement of the radially inner crown and skirt mating surfaces 112, 114, and need not be fixedly secured. Alternatively, the radially inner crown and skirt mating surface 112, 114 may be in abutment due to the securement of the radially outer crown and skirt mating surface 111, 113. Additionally, both the crown and skirt radially inner and outer mating surfaces 111, 112, 113, 114 may be fixedly secured. The radially inner mating surfaces of the crown and skirt 112, 114 (e.g., the radially inner interface region 115 or radially inner joint 131) may be formed below the combustion bowl area 106. Alternatively, the radially inner mating surfaces of the crown and skirt 112, 114 may be formed in the combustion bowl area 106.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent upon reading the above description. It is anticipated and intended that future developments will occur in the arts discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A piston, comprising:

a piston crown having a longitudinal axis and including a radially inner crown mating surface and a radially outer crown mating surface, the piston crown defining at least in part a cooling gallery extending about a periphery of the piston crown; and a piston skirt, including:

a pair of oppositely disposed pin bosses, the pin bosses each defining a piston pin bore;

a radially inner skirt mating surface cooperating along a radially inner interface region with the radially inner crown mating surface;

a radially outer skirt mating surface cooperating along a radially outer interface region with the radially outer crown mating surface such that the cooling gallery is substantially enclosed; and at least one cooling fin extending from an interior surface of the cooling gallery, the at least one cooling fin having an axial extent and a radial extent transverse to the axial extent, wherein the axial extent is greater than the radial extent, and wherein the radial extent is greatest at a base of the at least one cooling fin and decreases in a direction away from the interior surface from which the at least one cooling fin extends.

2. The piston of claim 1, wherein the at least one cooling fin is formed in one of an upper interior surface of the cooling gallery and an interior lower surface of the cooling gallery.

3. The piston of claim 1, wherein at least two cooling fins extend from the interior surface of the cooling gallery, and wherein one of the at least two cooling fins extends from an axially lower interior surface of the cooling gallery and another of the at least two cooling fins extends from an axially upper interior surface of the cooling gallery.

4. The piston of claim 3, wherein at least a free end of the at least two cooling fins overlap in an axial direction along the longitudinal axis.

5. The piston of claim 1, wherein the piston crown and the piston skirt form at least one of a friction welded joint, a laser welded joint and a brazed joint along at least one of the radially inner interface region and the radially outer interface region.

6. The piston of claim 1, wherein the radially inner skirt mating surface and the radially inner crown mating surface couple at the radially inner interface region to define a radially inner joint, and wherein the radially inner joint is disposed in a combustion bowl when the at least one cooling fin is arranged extending from an upper interior surface of the cooling gallery.

7. The piston of claim 1, wherein the radially inner skirt mating surface and the radially inner crown mating surface couple at the radially inner interface region to define a radially inner joint, and wherein the radially inner joint is disposed below the combustion bowl when the at least one cooling fin is arranged extending from a lower interior surface of the cooling gallery.

8. The piston of claim 1, wherein the interior surface of the cooling gallery is depressed axially to define a radius at the base of the at least one cooling fin adjacent to a radially inner surface and a radially outer surface of the at least one cooling fin.

9. A piston, comprising:

a piston crown having a longitudinal axis and including a first crown mating surface and a second crown mating surface, the piston crown defining at least partially a cooling gallery extending about a periphery of the piston crown;

a piston skirt, including:

a pair of oppositely disposed pin bosses, the pin bosses each defining a piston pin bore;

a first skirt mating surface cooperating with the first crown mating surface along a first interface region;

a second skirt mating surface cooperating with the second crown mating surface along a second interface region, at least one of the first interface region and the second interface region securely fixed to define a joint;

wherein the piston crown and the piston skirt together define an interior surface of the cooling gallery such that the cooling gallery is substantially enclosed; and at least one cooling fin extending from at least one of an upper boundary and an axially lower boundary of the interior surface of the cooling gallery, the at least one cooling fin having a radial extent that decreases gradually in a direction away from the interior surface from which the at least one cooling fin extends.

10. The piston of claim 9, wherein at least two cooling fins are disposed in the cooling gallery, and wherein one of the at least two cooling fins extends from the upper boundary of the interior surface and another of the at least two cooling fins extends from the lower boundary of the interior surface such that a free end of the at least two cooling fins overlap in an axial direction along the longitudinal axis.

11. The piston of claim 9, wherein the first interface region defines the joint, and the joint is a first radially inner joint disposed in a combustion bowl; and wherein the second interface region defines a second radially inner joint, the second radially inner joint disposed below the combustion bowl.

12. A method, comprising:

providing a piston crown having a longitudinal axis and including a first crown mating surface and a second crown mating surface, the piston crown defining at least in part a cooling gallery extending about a periphery of the piston crown;

providing a piston skirt including a first skirt mating surface and a second skirt mating surface;

forming at least one cooling gallery fin from at least one of the piston crown and the piston skirt;

adjoining the piston crown to the piston skirt, wherein adjoining the piston crown to the piston skirt includes coupling the first crown mating surface and the second crown mating surface with the first skirt mating surface and the second skirt mating surface to form a first interface region between the first crown mating surface and the first skirt mating surface, a second interface region between the second crown mating surface and the second skirt mating surface, and the cooling gallery defined by the piston crown together with the piston skirt, wherein the piston skirt includes a pair of oppositely disposed pin bosses defining a piston pin bore; and wherein the at least one cooling gallery fin extends from an interior surface of the cooling gallery and has an axial extent greater than a radial extent, and wherein the radial extent is greatest at a base of the at least one cooling gallery fin and decreases in a direction away from the interior surface from which the at least one cooling gallery fin extends.

13. The method of claim 12, wherein adjoining the piston crown to the piston skirt further includes fixing the piston crown and the piston skirt together along at least one of the first interface region and the second interface region via at least one of friction welding, laser welding and brazing.

14. The method of claim 12, wherein forming the at least one cooling gallery fin includes machining a plurality of fins from a block portion formed within the cooling gallery.

15. The method of claim 12, wherein the at least one cooling gallery fin extends from an axially upper interior surface of the cooling gallery.

16. The method of claim 15, wherein the first interface region defines a joint, and the joint is a radially inner joint disposed in a combustion bowl area of the piston.

17. The method of claim 12, wherein the at least one cooling gallery fin extends from an axially lower interior surface of the cooling gallery.

18. The method of claim 17, wherein the first interface region forms a radially inner joint disposed below a combustion bowl area of the piston.

19. The method of claim 12, wherein the first interface region defines a first radially inner joint disposed in a combustion bowl area of the piston; and wherein the second interface region defines a second radially inner joint disposed below the combustion bowl area.

20. The method of claim 12, wherein forming at least one cooling gallery fin includes forming at least two cooling gallery fins, wherein one of the at least two cooling gallery fins extends from an axially upper interior cooling gallery surface and another of the at least two cooling gallery fins extends from an axially lower interior cooling gallery surface such that a free end of the at least two cooling gallery fins overlap in an axial direction along the longitudinal axis.

* * * * *